US005588363A

United States Patent [19]

Becker

[11] Patent Number: 5,588,363

[45] Date of Patent: Dec. 31, 1996

[54] METHOD AND DEVICE FOR PERFORMING OPERATING STEPS IN AN ADJUSTMENT OF A PRINTING PRESS

[75] Inventor: Willi Becker, Bammental, Germany

[73] Assignee: Heidelberger Druckmaschinen AG, Heidelberg, Germany

[21] Appl. No.: 376,430

[22] Filed: Jan. 23, 1995

[30] Foreign Application Priority Data

Jan. 21, 1994 [DE] Germany ..... 44 01 684.0

[51] Int. Cl.[6] ..... B41F 5/02; B41F 21/10; B41F 1/20

[52] U.S. Cl. ..... 101/230

[58] Field of Search ..... 101/229, 330, 101/231, 183, 232, 485, 486, 136, 141, 409–411, 216, 230; 271/225, DIG. 902, 184

[56] References Cited

U.S. PATENT DOCUMENTS

| | | |
|---|---|---|
| 4,014,261 | 3/1977 | Becker . |
| 4,580,494 | 4/1986 | Becker . |
| 5,031,531 | 7/1991 | Becker . |
| 5,033,379 | 7/1991 | Becker . |
| 5,076,164 | 12/1991 | Becker . |
| 5,085,343 | 2/1992 | Becker . |
| 5,105,737 | 4/1992 | Becker . |

FOREIGN PATENT DOCUMENTS

| | | |
|---|---|---|
| 1257090 | 12/1967 | Germany . |
| 2460503 | 7/1976 | Germany . |
| 3136349 | 8/1982 | Germany . |
| 8319431 | 2/1984 | Germany . |
| 3814831 | 10/1989 | Germany . |
| 3836310 | 4/1990 | Germany . |
| 3900818 | 5/1990 | Germany . |
| 3911630 | 10/1990 | Germany . |
| 3911609 | 10/1990 | Germany . |
| 3920821 | 1/1991 | Germany . |
| 4223190 | 1/1994 | Germany . |
| 2225556 | 6/1990 | United Kingdom . |
| 2275446 | 8/1994 | United Kingdom . |

*Primary Examiner*—J. Reed Fisher
*Attorney, Agent, or Firm*—Herbert L. Lerner; Laurence A. Greenberg

[57] ABSTRACT

Method of performing operating steps in an adjustment of a printing press, wherein adjusting members preloaded in one direction of motion are displaceable, in chronologically at least partly successive or sequential operating steps, in a direction opposite to the one direction by adjusting cylinders upon which a pressure medium is actionable includes acting, via a first pressure medium system having a pressure limitation controllable in stages, upon a second pressure medium system to which a plurality of adjusting cylinders, at least some of which are preloaded with different forces, are connected; and device for practicing the method.

9 Claims, 3 Drawing Sheets

7
7.1
8
1
87
11
F2
F1
12.2
46
45
16
47
44
43
23
39
21
20
24
40
19
17
41
42
30
32
35
34
33
28
12.1
37
36
38
29
31
13
18
62
50
22
60
48
59
49
12.3
63
58
14
64
65
55
56
57
61
54
53
12.4
51
25
26
52
27
15

METHOD AND DEVICE FOR PERFORMING OPERATING STEPS IN AN ADJUSTMENT OF A PRINTING PRESS

BACKGROUND OF THE INVENTION

FIELD OF THE INVENTION

The invention relates to a method of performing operating steps in an adjustment of a printing press, preferably in the conversion of a sheet-fed printing machine press for recto/verso or first form and perfector printing wherein adjusting members preloaded in one direction of motion are displaceable in chronologically, at least partly successive or sequential operating steps in a direction opposite to the one direction by means of adjusting cylinders upon which a pressure medium is actionable, and to a device for performing the foregoing method.

Adjustable printing presses, especially printing presses which are convertible between one-sided and two-sided printing, have become known heretofore in many different versions, for example, from U.S. Pat. Nos. 5,076,164; 5,085,143; 5,033,379; 5,105,737; 5,031,531 and 4,014,261. The last-mentioned reference describes a printing press for printing sheets in the one-sided and two-sided printing modes, wherein a sheet arriving from a printing unit is gripped at the leading edge thereof by the gripper system of a transfer drum and transferred by the leading edge to the gripper system of a storage drum, which delivers the sheet to a further drum before the sheet arrives in the next printing unit. In two-sided printing, the latter drum serves as a sheet inverting drum. The sheet is then gripped at the trailing edge thereof by a gripper system of the inverting drum, which performs a 180° swivelling motion, so that the turned-over sheet then enters the next printing unit with the trailing edge thereof in leading position and printing is then performed on what was previously the reverse side thereof.

To convert the printing press from one-sided, i.e., first form or recto, printing to two-sided, i.e., first form and perfector or recto/verso, printing, or to bring the sheet inverting device into engagement and to disengage it again, it is necessary, in a first step, for the transport drums which are driven, for example, by a common gear train, to be brought into a defined conversion position (zero position) wherein a zero-position pulse or signal is transmitted, for example, by an incremental angle encoder, such as is described in published British Patent Document GB 2 225 556 A.

Only after the foregoing first step has been performed, can the phase relationship of the printing units to one another be adjusted in a further step, wherein a nonrotatable first element in the printing press drive system is held fast, and an adjustable second element of the drive system is rotated a defined angular amount relative to the first element. For holding the nonrotatable element fast, conventional means such as catch members, clamping jaws and the like may be used. The adjustment of the rotatable element is effected either by the main drive of the printing press or by an additional adjusting drive.

In yet another step, the opening times for the grippers of the drums which receive the sheet and which transfer the sheet are adjusted. The control members for setting the instants of the gripper opening times are adjustable in infinitely graduated fashion and are connected to the respective transport drum by clamping, so that this clamping must first be released before the control members for the gripper opening times of both the inverting drum and the storage drum can be displaced by means of separate drive elements. In another step, a device holding the trailing edge of the sheet of a transport drum serving as a storage drum can be adjusted to the end of the respective sheet following thereafter, in accordance with the sheet size or format. Once again, a clamped connection must first be released before it is possible to adjust the angular position of this device relative to the grippers which hold the leading edge of the sheet.

Finally, all the connection which have been released must be remade or connected again after the conversion has been effected. The published German Patent Document DE 31 36 349 A1 and German Utility Model DE-GM 83 19 431 disclose hydraulic adjusting cylinders for loosening and tightening the clamping devices of the transport drum control elements which are adjustable for conversion of the printing press, but rotary ducts for supplying the hydraulic fluid to the working cylinders are necessary, because the latter are disposed on drums which rotate. For every switching or tightening operation, one or even more pressure lines are required, so that expensive multiple rotary ducts are necessary.

SUMMARY OF THE INVENTION

It is accordingly an object of the invention to provide a method and device for performing operating steps in an adjustment of a printing press wherein maximally automatic adjustment of a printing press is achieved when a print change takes place, in particular when converting a sheet-fed printing press from one-sided printing to two-sided printing and vice versa, employing motorized adjusting forces.

With the foregoing and other objects in view, there is provided, in accordance with the invention, a method of performing operating steps in an adjustment of a printing press, wherein adjusting members preloaded in one direction of motion are displaceable, in chronologically at least partly successive or sequential operating steps, in a direction opposite to the one direction by means of adjusting cylinders upon which a pressure medium is actionable, which comprises acting, via a first pressure medium system having a pressure limitation controllable in stages, upon a second pressure medium system to which a plurality of adjusting cylinders, at least some of which are preloaded with different forces, are connected.

In accordance with the method according to the invention, the adjustment is a conversion of a sheet-fed printing press for recto/verso or first form and perfector printing from one-sided to two-sided printing and from two-sided to one-sided printing, respectively.

In the method according to the invention, the chronologically successively actuatable adjusting cylinders for the adjustment and conversion, respectively, have their own pressure stages in the first pressure medium system assigned thereto, the pressure stages being arrived at in succession. Accordingly, the pressure of the individual stages is transmitted to the pressure medium of the second pressure medium system, so that the adjusting cylinders associated with the pressure stage in the first pressure medium system are actuated by the second pressure medium system. Thus, a chronologically successive actuation of the adjusting cylinders intended for the adjustment and conversion, respectively, of the printing press occurs in a given order. This process proceeds for the most part automatically, and motorized adjusting forces are capable of effecting the respective adjustment and conversion.

For the constructional embodiment of the apparatus for carrying out such a method, preferably a pressure booster comprising a piston-cylinder unit is provided, having a differential piston, one piston face of which can be acted upon in a cylinder chamber with a pressure medium, controllable in pressure stages, of a first pressure medium system, and whose second piston face is operative in a cylinder chamber of a second pressure medium system connected to the adjusting cylinders.

In accordance with another aspect of the invention, there is provided a device for practicing a method of performing operating steps in an adjustment of a printing press, comprising a pressure booster including a piston-cylinder unit having a differential piston with a first piston face defining a first cylinder chamber, means for supplying to the first cylinder chamber, so as to act upon the first piston face, a pressure medium of a first pressure medium system, in a manner that the pressure medium is controllable in pressure stages, the differential piston having a second piston face defining a second cylinder chamber of a second pressure medium system, and a plurality of adjusting cylinders connected to the second pressure medium system.

In accordance with another feature of the invention, the adjustment of the printing press is a conversion of a sheet-fed printing press for recto/verso or first form and perfector printing from one-sided to two-sided printing and from two-sided to one-sided printing, respectively In accordance with a further feature of the invention, the first pressure medium system is a pneumatic pressure fluid system, and the second pressure medium system is an hydraulic pressure fluid system.

In accordance with an added feature of the invention, the device includes at least one switchable pressure controller connected to the first pressure medium system for pressure stage control of the first pressure medium system.

In accordance with an additional feature of the invention, the printing press has a compressed air supply, and the pneumatic pressure fluid system is connected to the compressed air supply of the printing press, and the device includes a pressure controller associated with at least one pressure stage of the pneumatic pressure fluid system.

In accordance with yet another feature of the invention, the device includes a multiway control valve connected in the first pressure medium system so that action of the first pressure medium system in a pressure stage is effected directly with the pressure of the pressure medium supply means.

In accordance with a concomitant feature of the invention, the device includes a pressure monitor for stopping the press when an action is exerted by the adjusting cylinders, the pressure monitor being connected in a line connecting the pressure booster and the adjusting cylinders.

Consequently, for acting upon a first piston face of the differential piston, a pneumatic pressure fluid system controllable in pressure stages can be provided, while the second piston face may be operative in a cylinder chamber of an hydraulic pressure fluid system. The pneumatic pressure fluid system may be supplied from the compressed air system of the press, and locating the pressure booster outside tight installation spaces in the printing press also makes it possible to provide a pressure booster of larger dimensions than otherwise possible. A conversion of the pressure stages of the pneumatic pressure system into a second pressure system which is hydraulic enables adequately strong adjusting forces with relatively short adjusting distances. The pressure stage control of the pneumatically acted-upon pressure fluid system is effected, for example, by switchable or adjustable pressure controllers, pressure limiters, or other means conventionally usable for this purpose; the operating pressure of the pressure fluid system can also define the first pressure stage. Instead of supplying the pneumatic pressure fluid system from the air system of the printing press, a separate compressed air source may also be provided for this purpose.

Other features which are considered as characteristic for the invention are set forth in the appended claims.

Although the invention is illustrated and described herein as embodied in a method and device for performing operating steps in an adjustment of a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
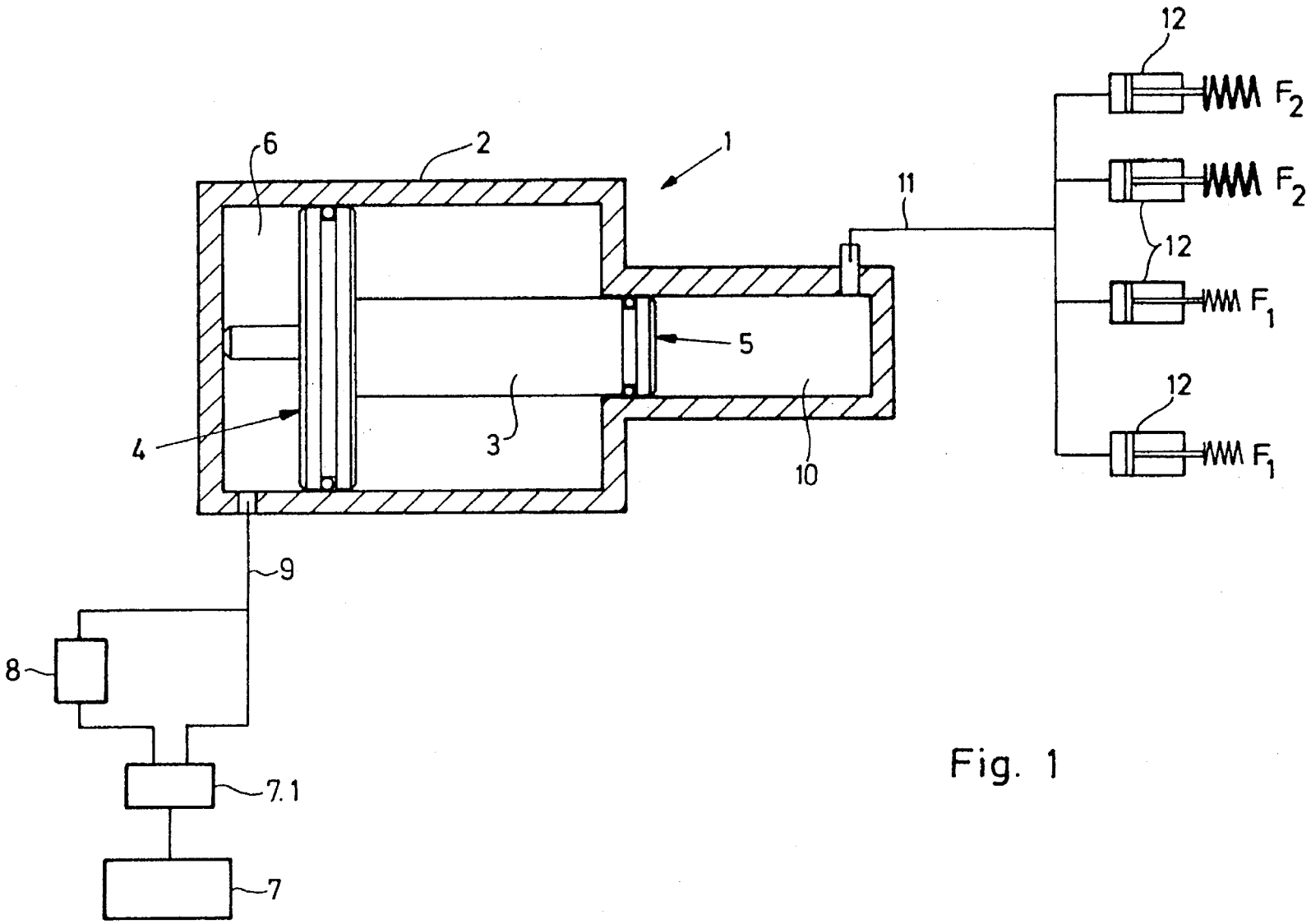
FIG. 1 is a schematic and diagrammatic view of a pressure booster, shown in vertical section and having adjusting cylinders connected thereto in accordance with the invention.

Referring now to the drawings and, first, particularly to FIG. 1 thereof, there is shown therein a pressure booster having a piston and cylinder unit 1 with a housing 2 wherein a differential piston 3 with two effective piston faces 4 and 5 is disposed. The piston face 4 is acted upon in a cylinder chamber 6 by a pneumatic pressure fluid system, which is supplied either from the air system of the printing press or from a separate compressed air source 7. The air pressure in the pneumatic compressed air system is defined in one of two pressure stages by the pressure of the air supply system of the press, and in the other pressure stage is controllable by a pressure regulator or controller 8. By means of a multiway valve 7.1, the compressed air can be supplied in a first pressure stage directly from the compressed air source 7, or via the pressure regulator 8 in another pressure stage, via an air line 9 into the cylinder chamber 6 of the pressure booster 1. The piston face 5 of the differential piston 3 is operative in a cylinder chamber 10 of an hydraulic pressure fluid system of the pressure booster 1. Via a line 11, the cylinder chamber 10 is connected to a plurality of adjusting cylinders 12. By way of example, these adjusting cylinders 12 are prebiased by respective springs individually or in groups counter to the action of the hydraulic pressure fluid system of the cylinder chamber 10. The schematic and diagrammatic view of FIG. 1 shows two adjusting cylinder groups F1 and F2 prestressed with different spring forces. This is also the number of pressure stages in the pneumatic pressure fluid system of the pressure booster 1. One pressure regulator 8 is assigned to one group of the adjusting cylinders F1 and F2, so that by means of this pressure regulator 8, a pressure adequate to actuate the adjusting cylinders of an appertaining group will be built up in the pressure booster 1. In the other pressure stage, the pressure of the air supply system is operative directly in the cylinder chamber of the pressure booster 1, so that a pressure adequate to actuate the other group is built up. Due to the lower pressure stage, a partial relief of the adjusting cylinders of the higher pressure stage thereby occurs, but this partial relief is so slight that no switching operation takes place as yet.

Figure 2:
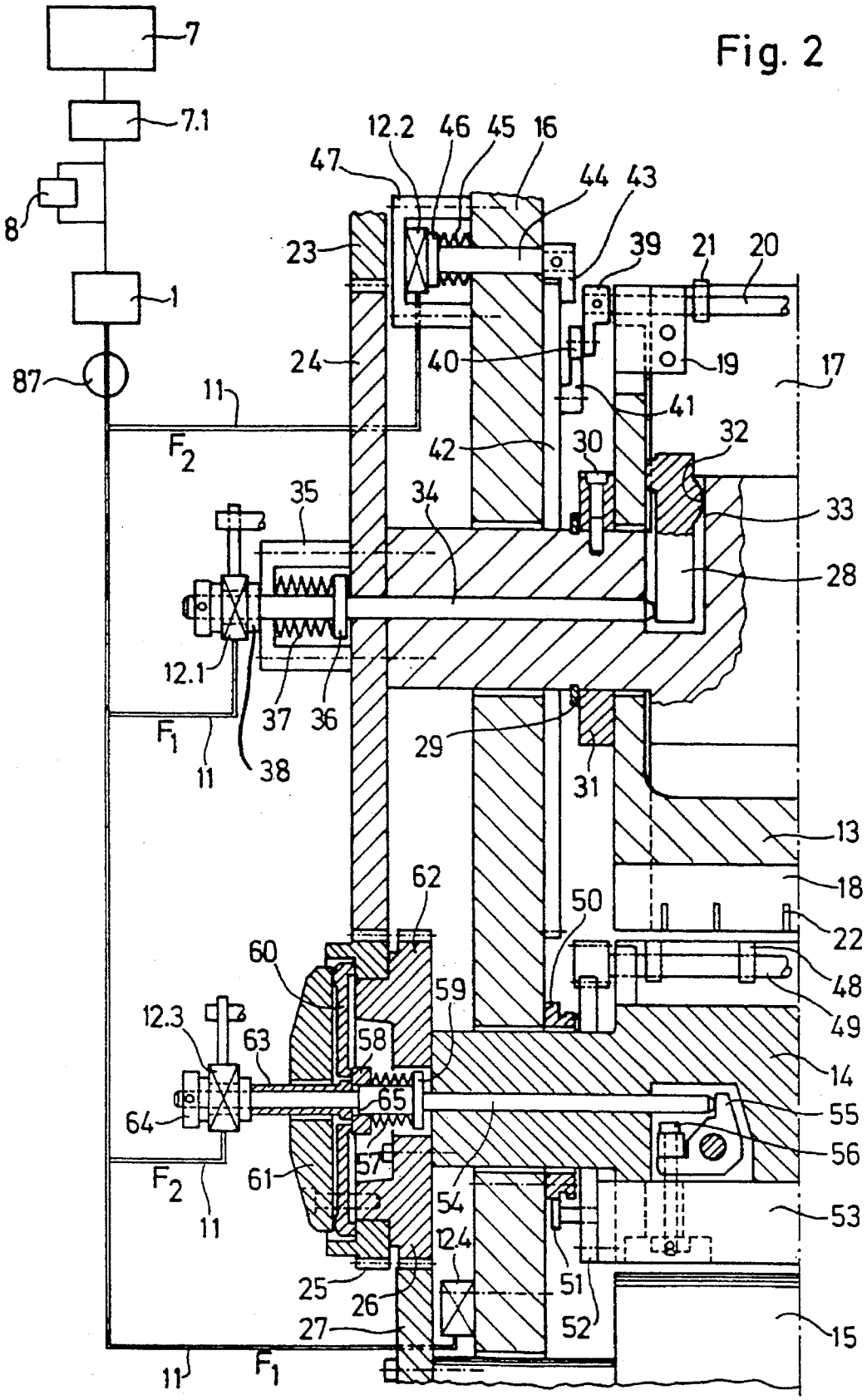
FIG. 2 is a schematic and diagrammatic view, in section, of a device for setting the sheet inversion in action and for taking it out of action on one side of the press.

The exemplary use of the features of the invention is shown in FIG. 2. From a vertical sectional view of one side of the press, it is apparent that the exemplary embodiment is associated with a storage drum 13, an inverting drum 14, and an impression cylinder 15, which are journalled on both sides of the press in respective side walls 16 of a printing press for two-sided printing. The storage drum 13 is formed of two segments 17 and 18, adjustable relative to one another in the circumferential direction of the drum; bearings 19 for a gripper shaft or bar 20 are located on the segment 17, whereon shaft grippers 21 for the leading edge of the sheet are disposed. The segment 18, disposed rotatably about a common pivot axis relative to the segment 17, carries suction means 22 for the trailing edge of the sheet which is guided on the circumference or peripheral surface of the storage drum 13. The impression cylinder 15, the inverting drum 14, and the storage drum 13 which has a diameter double that of conventional printing unit cylinders, such as the impression cylinder, for example, are driven by a gear train of a transmission system. Starting from a gear wheel 23 on a preceding transport drum, the drive of the storage drum 13 is effected by a gear wheel 24, the drive of the inverting drum 14 by a ring gear (gear wheel) 25 and a gear wheel 26, and the drive of the impression cylinder 15 by a gear wheel 27. The gear wheels 24, 26 and 27 are each fixedly disposed on shaft ends of the storage drum 13, inverting drum 14 and printing cylinder 15 journalled in the side walls 16.

The segments 17 and 18 are connected to one another by a clamping device. In this clamping device, a short arm of a clamping lever 28 presses the adjustable segment 18 against a counteracting bearing 31 secured to the shaft end of the storage drum 13 by a retaining ring 29 and screws 30. The clamping lever 28 is braced by a cam 32 against a flat face 33 of the segment 17. The cam 32 is disposed to one side, so that the clamping lever 28 has the one short lever arm and one long lever arm. An inner end of a pressure bar 34, which is guided axially displaceably and coaxially in the storage drum 13 and extends therethrough at an inner end face thereof, is directed towards the end of the long lever arm. This pressure bar 34 is loaded or biased by a spring 37, which is braced, at one end thereof, against a bridge 35 and, at the other end thereof, against a pressure bar flange 36, in such a way that the segments 17 and 18 of the storage drum, as a result of the lever ratio of the clamping lever 28, are firmly joined to one another by a friction lock. The resultant clamping of the segments 17 and 18 is releasable with the aid of an hydraulic adjusting cylinder 12.1 which, when the piston of the working cylinder is subjected to pressure, presses against a stop ring 38 secured to the pressure bar 34, so that the ring 37 is compressed and the clamping between the two segments 17 and 18 is released. Via the line 11, the adjusting cylinder 12.1 is connected to the pressure booster 1, shown symbolically. The relative adjustment of the segments 17 and 18 is performed by hand or by machine. For gripper control, a roller lever 39 is secured to the gripper shaft 20, and carries on a free end thereof a cam roller 40 which rolls along a cam plate 41 disposed on an adjustable toothed segment 42. The toothed segment 42 is clamped to the side wall 16 by a clamping member 43, which is disposed on the inner end of a bolt 44 guided axially displaceably in the side wall 16. In the clamping direction, the bolt 44 is loaded by a spring 45, which is braced at one end against the side wall 16 and at the other end against a flange ring 46 on the bolt 44. For releasing this clamped connection, an adjusting cylinder 12.2 is provided between the bolt 44 and a yoke 47 secured to the sidewall 16; the piston and working cylinder of this adjusting cylinder 12.2 are braced at one end against the bolt 44 and at the other end against the yoke 47. This adjusting cylinder 12.2 is likewise connected to the hydraulic pressure system of the pressure booster 1 via the line 11. With the clamping released, the angular adjustment of the toothed segment 42 is effected in a conventional manner manually or automatically via an adjusting shaft (not shown in the drawings), on which a pinion which engages in the toothing is disposed and which is rotatably supported in the side wall 16.

Tongs grippers 48 are disposed on a gripper bar 49 on the inverting drum 14 and, for example, are formed in a conventional manner. Control of the tongs grippers 48 on the gripper bar 49 of the inverting drum 14 is effected by double cams 50, preferably secured to both sides of the press on the side wall 16, a cam roller 51, respectively, rolling on each of the cams 58 and moving a gripper control segment 52. This gripper control segment 52 is secured at an end face thereof to a carriage 53 displaceably guided axially on the inverting drum 14, so that the cam roller 51 is adjustable by axial movement of the carriage 53 from one cam to the other cam of the double cam 50. The carriage 53 is radially clamped to the inverting drum 14 by a further clamping device. To that end, a pressure bar 54 is axially movably supported coaxially in the inverting drum 14, and a free end of the bar 54 is directed towards one arm of a bell crank 55 pivotally supported in the inverting drum 14, the other arm of the bell crank 55 engaging under a tie rod 56 which is radially movably guided and connected to the carriage 53. The other end of the pressure bar 54, which extends to the outside, passes through both a spring 57 and a pressure ring 58. The spring 57 is braced at one end thereof against the pressure ring 58 and at the other thereof against a flange 59 of the pressure bar 54. A counteracting bearing for the pressure ring 58 is provided by a plurality of clamping levers 60 and by a printing plate 61, which is firmly connected to the gear wheel 26. The pressure ring 58 presses against the inner ends of the clamping levers 60 which, with the outer ends thereof, in turn, press the gear wheel 25 against the gear wheel 26, the clamping levers 60 being braced against the printing plate 61 by cams formed in the vicinity of the outer ends thereof. A sleeve 63 is axially movably slipped onto the end of the pressure bar 54 extending to the outside; one end of the sleeve 63 engages the pressure ring 58, and the other end cooperates with the adjusting cylinder 12.3, which is braced at the other end thereof against a flange ring 64 secured to the free end of the pressure bar 54. By actuation of the adjusting cylinder 12.3, the sleeve 63 is displaced on the pressure bar 64 until it meets a step shoulder 65 formed on the pressure bar 64, so that the clamping action between the gear wheels 25 and 26 and of the carriage 53 at the inverting drum 14 is released. This adjusting cylinder 12.3 is likewise connected to the pressure booster 1 by a line 11.

A further adjusting cylinder 12.4 is secured to the outside of the side wall 16, the piston of which, when acted upon by the pneumatic fluid, causes the adjusting cylinder 12.4 to press against the end face of the gear wheel 27 and hold it fast for the duration of the conversion process. This adjusting cylinder 12.4 is likewise connected to the pressure booster 1 through the line 11o By the action of the pressure booster 1, upon its actuation in the first pressure stage F1, the adjusting cylinder 12.4 is acted upon first, so that the drive of the drums is blocked in the zero position. At the same time, the adjusting cylinder 12.1 can be acted upon in order to release the clamping for a sheet size or format adjustment on the storage drum. In a further pressure stage F2, pressure fluid is then applied to the piston in the adjusting cylinder 12.2 to release the clamping of the toothed segment 42 for adjusting the gripper opening, and at the same time the adjusting cylinder 12.3 is activated for releasing the clamping for the toothed ring adjustment and for releasing the carriage 53 at the inverting drum 14. After the conversion operations have been performed, a pressure relief of the adjusting cylinders 12.2 and 12.3, which, in combination, form the pressure stage F2, is effected by a pressure relief of the pressure booster 1, so that the appertaining clampings are operative once again, before a relief of the adjusting cylinders 12.1 and 12.4 takes place in the pressure stage F1, so that the release of the driving gear wheel 27 does not take place until all of the clamped connections are again operative.

A pressure monitor 87 in the line 11 of the second pressure fluid system causes the press to stop during conversion of the press, and does not enable press operation until the line 11 is unpressurized, respectively.

Figure 3:
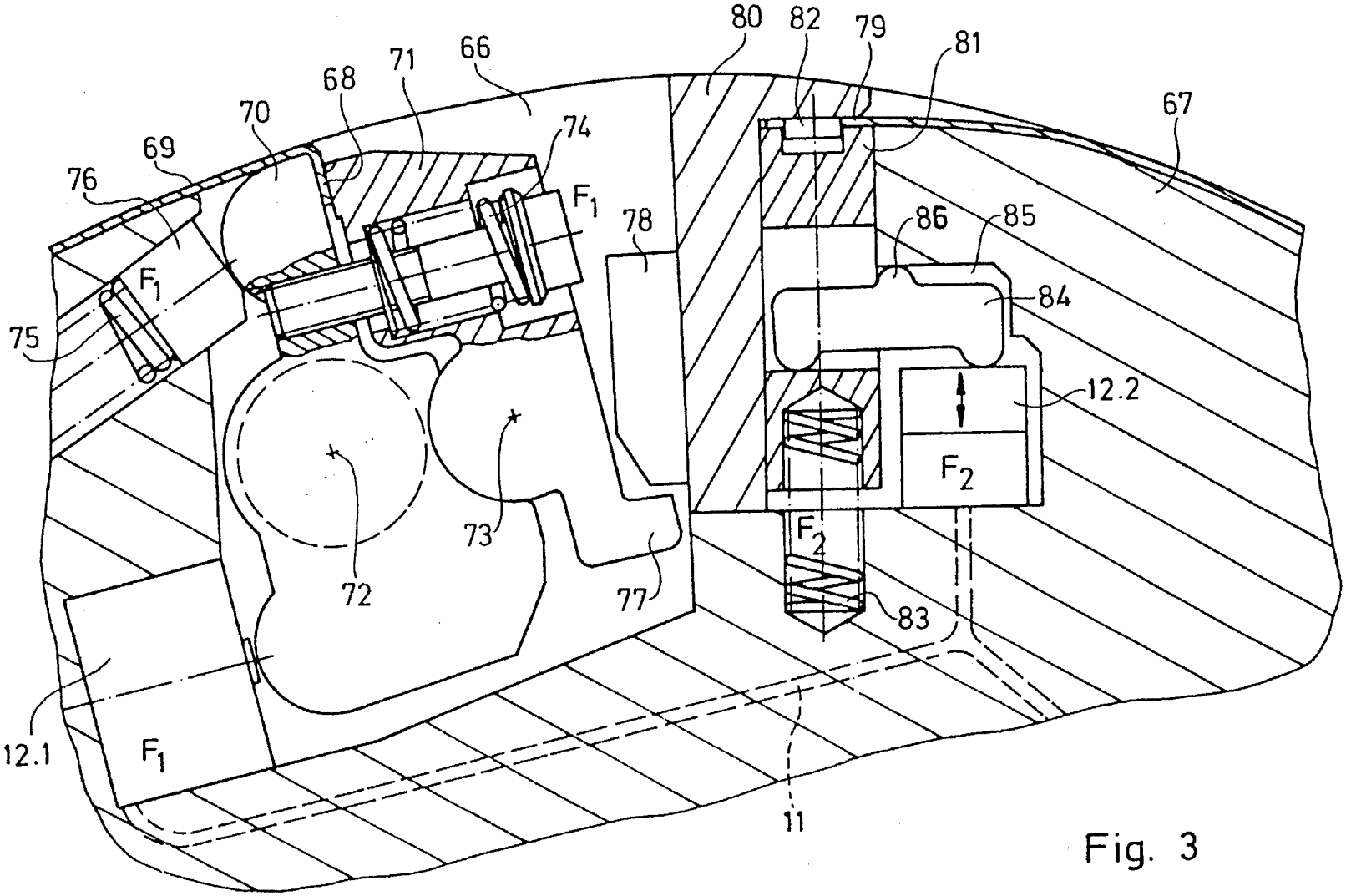
FIG. 3 is a cross-section view of an automatic plate tightening device according to the invention in a plate cylinder of a sheet-fed printing press.

FIG. 3 illustrates the use of the features of the invention in a clamping and tightening device for the trailing edge and the leading edge of the printing plate of a plate cylinder of a printing press. The clamping and tightening device is disposed in a channel 66 of the cylinder 67, the channel being open towards the outside and disposed parallel to the axis of the cylinder 67. The angularly bent trailing end 68 of the printing plate 69 is held between the clamping faces of two clamping strips 70 and 71. Both clamping strips 70 and 71 are supported so as to be pivotable about axes 72 and 73 in the channel 66. Both clamping strips 70 and 71 are also formed as double levers, the clamping faces of the strips 70 and 71 being disposed on the ends of the outwardly directed lever arms. An adjusting unit 12.1 is operative in the pivoting direction about the axis 72 towards the inwardly directed end of the clamping lever 70. The clamping of the trailing end 68 of the printing plate 69 is effected by the biasing action of a spring 74. For tensioning the printing plate 69 in the circumferential direction, a spring 75 is operative against a pressure piece 76, which engages a spherical or crowned contour of the clamping strip 70. The clamping strip 71 is formed with a somewhat spherical cross section by which it is braced in a cup-shaped indentation or calotte formed in the outer clamping strip 70, so that the pivot axis 73 is movable within the channel 66. A support arm 77 is disposed on the inner end of the clamping strip 71 and cooperates with a stop 78 affixed to the cylinder. The release of the clamped connection is effected by actuation of the adjusting cylinder 12.1, so that the clamping strip 70 moves counterclockwise about the pivot axis 72 and consequently, pushes the pressure piece 76 back, in a direction counter to the action of the spring 75. The support arm 77 comes to rest against the stop 78, so that a relative swiveling of the two clamping strips 70 and 71 with respect to one another occurs, and the clamping gap between the clamping faces of the two clamping strips 70 and 71 is opened. A relieving of the adjusting cylinder 12.1 leads automatically to a re-clamping of the trailing edge 68 of the printing plate 69 and to the tightening thereof in the circumferential direction.

A further clamping and tightening device is provided for the leading edge 79 of the printing plate 69. It is formed of an upper clamping strip 80, disposed in a stationary manner on the cylinder, and a lower clamping strip 81 which by comparison is radially displaceable on the cylinder, the clamping faces extending somewhat peripherally. For alignment purposes, a register pin 82 is provided. The lower clamping strip 81 is biased perpendicularly to the clamping face thereof by the loading force of a spring 83, which produces a friction lock between the clamping faces of the upper clamping strip 80 and the lower clamping strip 81. To release this clamping connection, a double lever 84 is disposed in a recess 85 formed in the cylinder 67 and is braced approximately in the middle thereof by a knob or projection 86 or the like against the cylinder 67 and is braced by the ends thereof against the lower clamping strip 81 on one end and against an adjusting cylinder 12.2 on the other end. When this adjusting cylinder 12.2 is subjected to the action of pneumatic fluid, the lower clamping jaw 81 is pressed inwardly counter to the loading force of the spring 83, and the clamped connection between the two clamping strips 80 and 81 is released. The release of the clamping of the trailing end 68 of the printing plate 69 between the clamping faces of the clamping strips 70 and 71, and the release of the clamping of the leading end 79 of the printing plate 69 between the clamping strips 80 and 81, must take place in chronological succession, in order to release a printing plate 69 from the cylinder 67. When the printing plate is tightened, then in reverse order, a clamping of the leading edge 79 of the printing plate 69 between the clamping faces of the clamping strips 80 and 81 must occur first, and only chronologically thereafter can a clamping of the trailing end 68 of the printing plate 69 between the clamping strips 70 and 71 and a tightening of the printing plate 69 in the circumferential direction by the spring 75 via the pressure piece 76 occur. The adjusting cylinders 12.1 and 12.2 correspondingly harmonize or agree with the pressure stages F1 and F2, respectively, of the pressure booster 1.

I claim:

1. A printing machine having a plurality of adjusting components comprising:

a) a pressure medium source for providing a first pressure medium;

b) a first pressure system supplied with the first pressure medium;

c) a second pressure system filled with a second pressure medium in operative engagement with the adjusting components, and means for pressurizing the second pressure medium in the second pressure system in response to pressure applied to said first pressure system by said pressure medium source; and means for moving each of said plurality of adjusting components in response to a fluid under pressure from said pressure medium source for acting against a respective counter force;

d) said second pressure system in operative engagement with the adjusting components for moving each of the adjusting components against a respective counter force;

e) means for causing the first pressure system to apply pressure at different pressure stages to second pressure system;

f) said adjusting components are divided into groups, and wherein the counter forces are different from group to group;

g) means for balancing the counter force against the adjusting components of a respective group against the corresponding pressure stage;

h) means for performing a first work step under pressure of a first pressure stage and for performing a further work step under pressure of a further pressure stage, and i) means for providing a pressure to the further pressure stage greater than the pressure of a preceding pressure stage.

2. A device according to claim 1 including a pressure translator having a low-pressure chamber for receiving the pressure medium under different pressure stages, and a high pressure chamber in operative engagement with the adjusting components.

3. Device according to claim 2, wherein said pressure translator includes a piston-cylinder unit having a differential piston with a first piston face defining said low pressure chamber, means for supplying pressure medium to said low pressure chamber with pressure medium from said first pressure system, said differential piston having a second piston face defining a high pressure chamber of said second pressure system, and a plurality of adjusting cylinders coupled to said adjusting components, and fluidly connected to said second high pressure chamber.

4. Device according to claim 1, wherein the adjusting components of the printing press include means for converting the press from one-sided to two-sided printing and conversely from two-sided to one-sided printing.

5. Device according to claim 1, wherein said first pressure system is a pneumatic pressure fluid system, and said second pressure system is an hydraulic pressure fluid system.

6. Device according to claim 1, including at least one switchable pressure controller connected to said first pressure system for providing pressure stage control of said first pressure system.

7. Device according to claim 4, wherein said pressure medium source includes a compressed air supply, and a pressure controller fluidly communicating with said compressed air supply.

8. Device according to claim 5, wherein said pressure controller includes a control valve connected to said first pressure system so that action of said first pressure system in a pressure stage is effected directly by the pressure of the pressure medium source.

9. Device according to claim 1, including a pressure monitor for stopping the printing machine when an action is exerted by the adjusting components, and a fluid line, said pressure monitor being connected in the fluid line connecting said second pressure system with said adjusting components.

* * * * *